US012722192B2

(12) United States Patent
Kirantay et al.

(10) Patent No.: US 12,722,192 B2
(45) Date of Patent: Sep. 1, 2026

(54) SLIDING MACHINE THAT CAN PROCESS TWO DIFFERENT SHEETS AT THE SAME TIME AND GIVE VARIABLE FORMS

(71) Applicant: SENTE MAKINA INSAAT SANAYI VE TICARET LIMITED SIRKETI, Istanbul (TR)

(72) Inventors: Ali Lutfu Kirantay, Istanbul (TR); Yavuz Dogan, Istanbul (TR)

(73) Assignee: SENTE MAKINA INSAAT SANAYI VE TICARET LIMITED SIRKETI, Istanbul (TR)

( * ) Notice: Subject to any disclaimer, the term of this patent is extended or adjusted under 35 U.S.C. 154(b) by 253 days.

(21) Appl. No.: 18/693,519

(22) PCT Filed: Aug. 15, 2022

(86) PCT No.: PCT/TR2022/050855
§ 371 (c)(1),
(2) Date: Mar. 20, 2024

(87) PCT Pub. No.: WO2023/043412
PCT Pub. Date: Mar. 23, 2023

(65) Prior Publication Data

US 2024/0383026 A1 Nov. 21, 2024

(30) Foreign Application Priority Data

Sep. 20, 2021 (TR) ..... 2021/014677

(51) Int. Cl.
*B21B 31/02* (2006.01)
*B21D 1/10* (2006.01)
(Continued)

(52) U.S. Cl.
CPC ..... *B21B 31/02* (2013.01)

(58) Field of Classification Search
CPC ..... B21B 31/02; B21D 5/14; B21D 51/06; B21D 51/10
(Continued)

(56) References Cited

U.S. PATENT DOCUMENTS

2021/0245223 A1* 8/2021 Ruegenberg ..... B21D 39/021

FOREIGN PATENT DOCUMENTS

GB 1389184 A 4/1975
KR 20150012601 A * 2/2015 ..... B21D 5/14
(Continued)

OTHER PUBLICATIONS

English translate (TR201600869U), retrieved date Jan. 13, 2026.*
English translate (KR20150012601A), retrieved date Jan. 13, 2026.*

*Primary Examiner* — Mohammed S. Alawadi
(74) *Attorney, Agent, or Firm* — Bayramoglu Law Offices LLC

(57) ABSTRACT

A sliding machine includes: at least one slide fixed to side parts on an upper surface of a main chassis, a second form roller unit positioned to move horizontally on the slide and located between a first form roller unit and a third form roller unit, a servo motor, two spindles of motion that transmit the motion drive to the rollers in a first form roller group, a second form roller group and a third form roller group through the wedge channel formed from one end to the other, at least one motion spindle gear fixed to the end of the spindle of motion, a motor which gives the driving power to the spindle of motion, a reducer positioned on the output shaft of the motor, at least one reducer gear sequentially fixed on the output shaft of the reducer and two sheet metal moving rails.

10 Claims, 6 Drawing Sheets

(51) Int. Cl.
*B21D 5/14* (2006.01)
*B21D 51/06* (2006.01)

(58) Field of Classification Search
USPC ..... 72/249
See application file for complete search history.

(56) References Cited

FOREIGN PATENT DOCUMENTS

| | | | | |
|---|---|---|---|---|
| TR | 201600869 | | | 4/2016 |
| TR | 201600869 | U | * | 4/2016 |
| TR | 201914795 | | | 10/2019 |
| WO | 2020002466 | A1 | | 1/2020 |

* cited by examiner

SLIDING MACHINE THAT CAN PROCESS TWO DIFFERENT SHEETS AT THE SAME TIME AND GIVE VARIABLE FORMS

CROSS REFERENCE TO THE RELATED APPLICATIONS

This application is the national phase entry of International Application No. PCT/TR2022/050855, filed on Aug. 15, 2022, which is based upon and claims priority to Turkish Patent Application No. 2021/014677, filed on Sep. 20, 2021, the entire contents of which are incorporated herein by reference.

TECHNICAL FIELD

This invention relates to a sliding machine that can be used for forming ventilation duct sheet and, in particular, can process two different sheets at the same time and apply variable or similar forms.

BACKGROUND

The need for ventilation and air conditioning systems is also increasing as a result of the increasing population in cities and the increase in indoor spaces accordingly. Especially in public living areas, this problem is solved with central ventilation-air conditioning systems, and ventilation ducts are of great importance for these systems to work effectively and efficiently.

Screw-in flanged ducts, which are currently the most used duct type in our country, are replaced by self-flange air ducts due to their more efficiency. Self-flange is preferred more because of its high efficiency, easier production and assembly and lower production costs. Since these air ducts are not produced in our country, they are produced with machine systems imported from abroad.

"Self-Flanged Ventilation Duct Production Line" is explained in the utility model application numbered TR201600869. This invention relates to the self-flange ventilation duct production line; feature, uncoiled profile chassis, sheet pulling group, conveyor unit chassis group, sheet metal sliding unit, sheet metal sliding unit chassis group, clamp unit chassis group, sheet metal sliding unit chassis group, flange unit chassis group, bending unit chassis group sliding unit chassis group consists of parts. In the aforementioned application, separate machines are needed to make the sheet edge forms in two different sizes. Therefore, there is a need for a new machine that can make two different forms in one machine.

In the patent application numbered TR201914795 of the applicant, "A machine that enables the processing of two different forms with an elevator mechanism" is described. This invention relates to a machine that enables the processing of two different forms, which can be used in forming the sheet of ventilation ducts, with an elevator mechanism. In the mentioned application, two different variable forms are provided by the elevator mechanism and there is a vertical movement. It is not possible to give different forms to two different sheets at the same time. The use of the elevator system is mandatory for the first and second form transitions, so some time losses will occur here. Also, here are two different motors associated with the form roller units. This application needs revision so that two different sheets can be processed at the same time by means of variable form rollers.

As a result, there is a need for a new technology that can overcome the disadvantages mentioned above, is useful, allows forming large or small sheet widths, is suitable for mass production, and ensures that the sheet comes out in the desired form and wall thickness.

SUMMARY

The main purpose of our system, which is the subject of the invention, is to ensure that two different sheet metal can be processed at the same time and to facilitate the production of the same or different forms optionally. This function is provided by positioning three form roller units on a slide on the same axis as each other. These three form machines are all mobile, the left and right ones are manually driven, and the middle ones are driven by a motor. In particular, the progression of the manually moving form machine units on the left and right on the rail is more sensitive as it is provided with screw threads. In the application numbered TR201914795, two different sheet metal processing cannot be done at the same time, only the sheet metal can be processed in different form roller groups in order to give different forms, and this process is carried out with the elevator mechanism. In this invention, although there is no elevator system, both two different sheet metals and two different forms can be given.

In existing systems, more than one motor is integrated into different form roller units, increasing costs and maintenance costs. However, in our invention, the pulley groups in all pulley units can operate with a single motor-driven movement with a single motor.

There is also a sheet metal movement rail in our invention. The wheels on this rail are self-joining, and they rotate during the processing of the sheet metal, making it easier for the sheet metal to move on the line. The height distance of this rail can be adjusted according to the form roller groups.

BRIEF DESCRIPTION OF THE DRAWINGS

The invention will be described with reference to the accompanying figures, so that the features of the invention will be more clearly understood and appreciated, but the purpose of this is not to limit the invention to these certain regulations. On the contrary, it is intended to cover all alternatives, changes and equivalences that can be included in the area of the invention defined by the accompanying claims. The details shown should be understood that they are shown only for the purpose of describing the preferred embodiments of the present invention and are presented in order to provide the most convenient and easily understandable description of both the shaping of methods and the rules and conceptual features of the invention. In these drawings.

Figure 1:
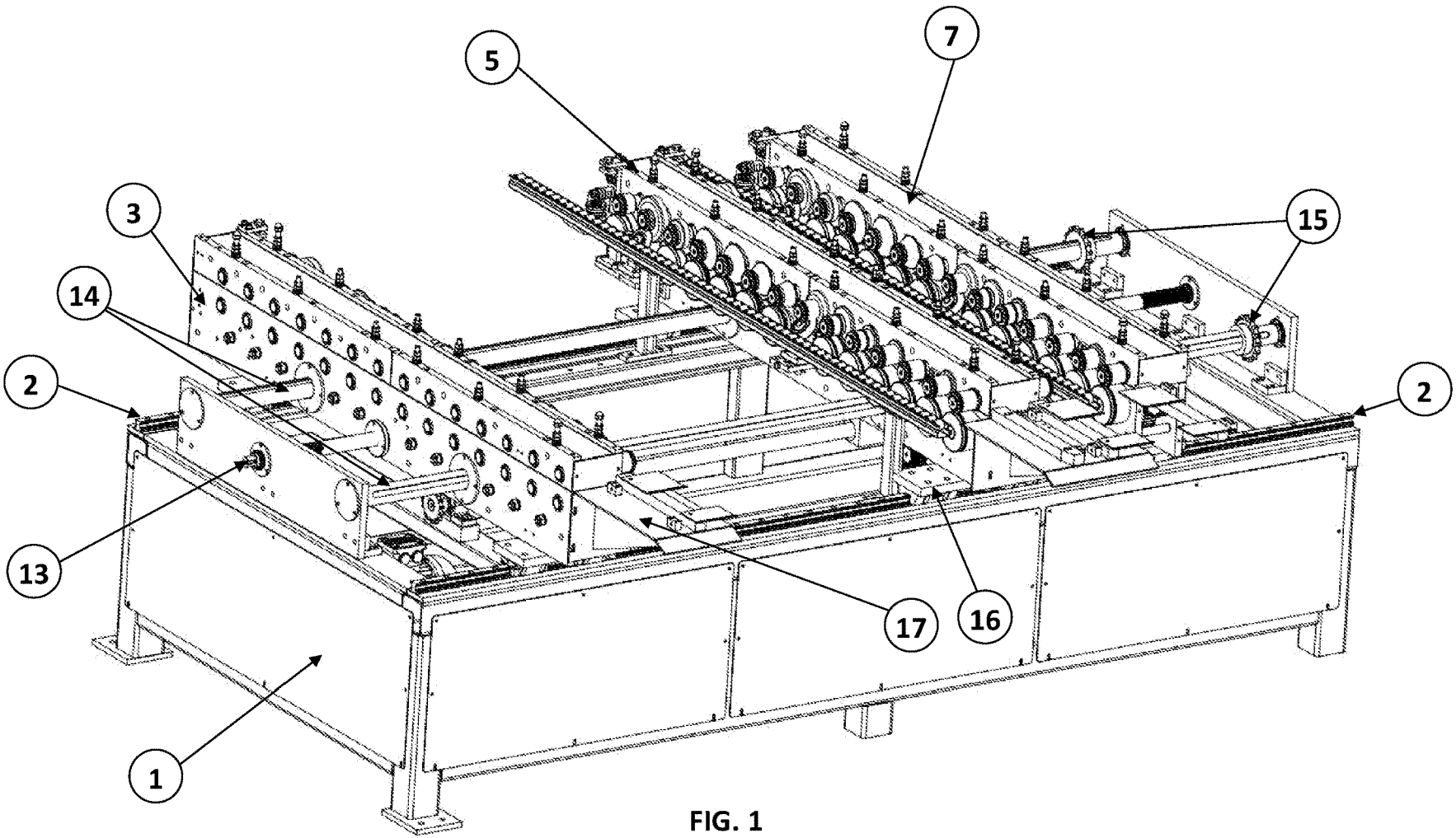
FIG. 1 General perspective view of the system.

The figures to help understand the present invention are numbered as indicated in the attached image and are given below along with their names.

DESCRIPTION OF REFERENCES

1. Main chassis

2. Slide

3. Form roller unit 1
4. Form roller group 1
5. Form roller unit 2
6. Form roller group 2
7. Form roller unit 3
8. Form roller group 3
9. Servo motor
10. Motor
11. Reducer
12. Reducer gear
13. Adjustment arm
14. Spindle of motion
14.1. Wedge channel
15. Motion spindle gear
16. Sledding feet
17. Sheet metal support wedge
18. Sheet metal moving rail

DETAILED DESCRIPTION OF THE EMBODIMENTS

The parts that make up the system that is the subject of the invention are basically; main chassis (1), slide (2), form roller unit 1 (3), form roller group 1 (4), form roller unit 2 (5), form roller group 2 (6), form roller unit 3 (7), form roller group 3 (8), servo motor (9), motor (10), reducer (11), reduction gear (12), adjustment arm (13), Spindle of motion (14), Motion spindle gear (15), sledding feet (16), sheet metal support wedge (17) and sheet metal movement rail (18). The spindle of motion (14) has a wedge channel (14.1) formed from one end to the other.

Figure 6:
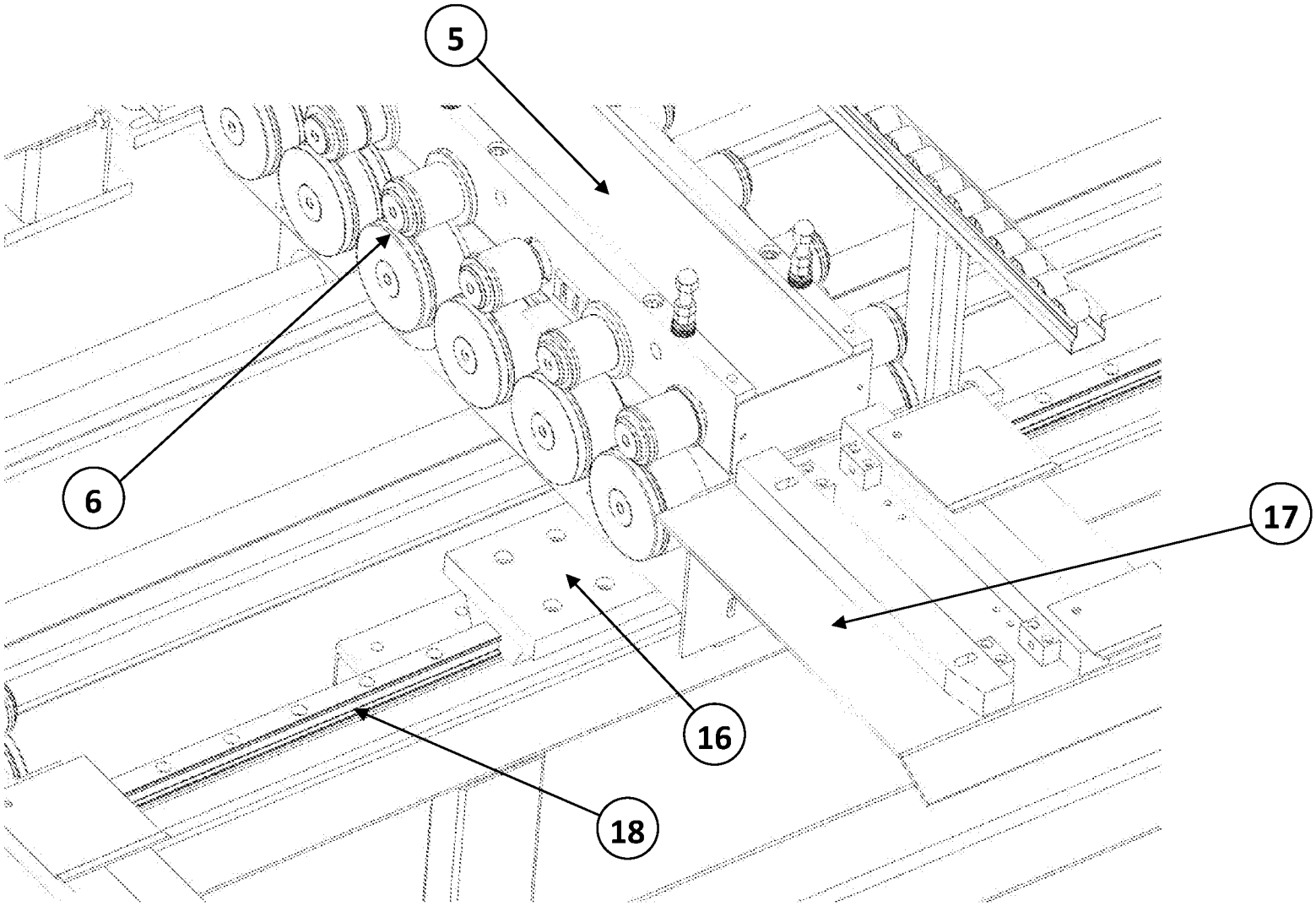
FIG. 6 Close-up perspective view of the middle form roller unit in the system.

In FIG. 1, the general perspective view of the system is given. The slide (2) is fixed on the main chassis (1) and on both sides. Form roller unit 1 (3) with form roller group 1 (4) to the left of the main frame (1), form roller unit 3 (7) with form roller group 3 (8) to the right of the main frame (1) and form roller unit 2 (5) with form roller group 2 (6) is located right in the middle of the main chassis (1). There are other roller units on the right and left of the form roller unit 2 (5). Form roller unit 2 (5), unlike other roller units, has form roller group 2 (6) fixed on both sides. This group of rollers can be symmetrical or asymmetrical to each other, but their structures can also be the same or different. Servo motor (9) and motor (10) group are fixed to the lower part of the main chassis (1). There is at least one reduction gear (12) on the reducer (11) part of the motor (10) positioned on the motor shaft. There is an adjustment arm (13) at the back of the form roller unit 1 (3) and the form roller unit 3 (7) groups. This adjustment arm (13) has screw threads formed on it. The spindle of motion (14) associated with the gears in the form roller group 1 (4), the form roller group 2 (6) and the form roller group 3 (8) embedded in each of the form roller units, through the wedge channel (14.1) formed from one end to the other. These shafts are two or more. Under each of the form roller units, there are sledding feet (16) that assist the movement on the Slide (2). Sheet metal support wedges (17), which serve to support the sheet metal that will enter the system, are fixed to the input and output sides of the form roller groups. The sheet metal movement rail (18) located between the form roller units, on the other hand, provide the forward movement of the sheet, which is processed on the form roller groups, during the process, by means of the frollery hinged wheels on it (FIG. 6). The height distance of the sheet metal movement rail (18) to the form roller groups can be adjusted, and this adjustment can be provided manually with the pin holes on it, as well as automatically with the pistons.

Figure 2:
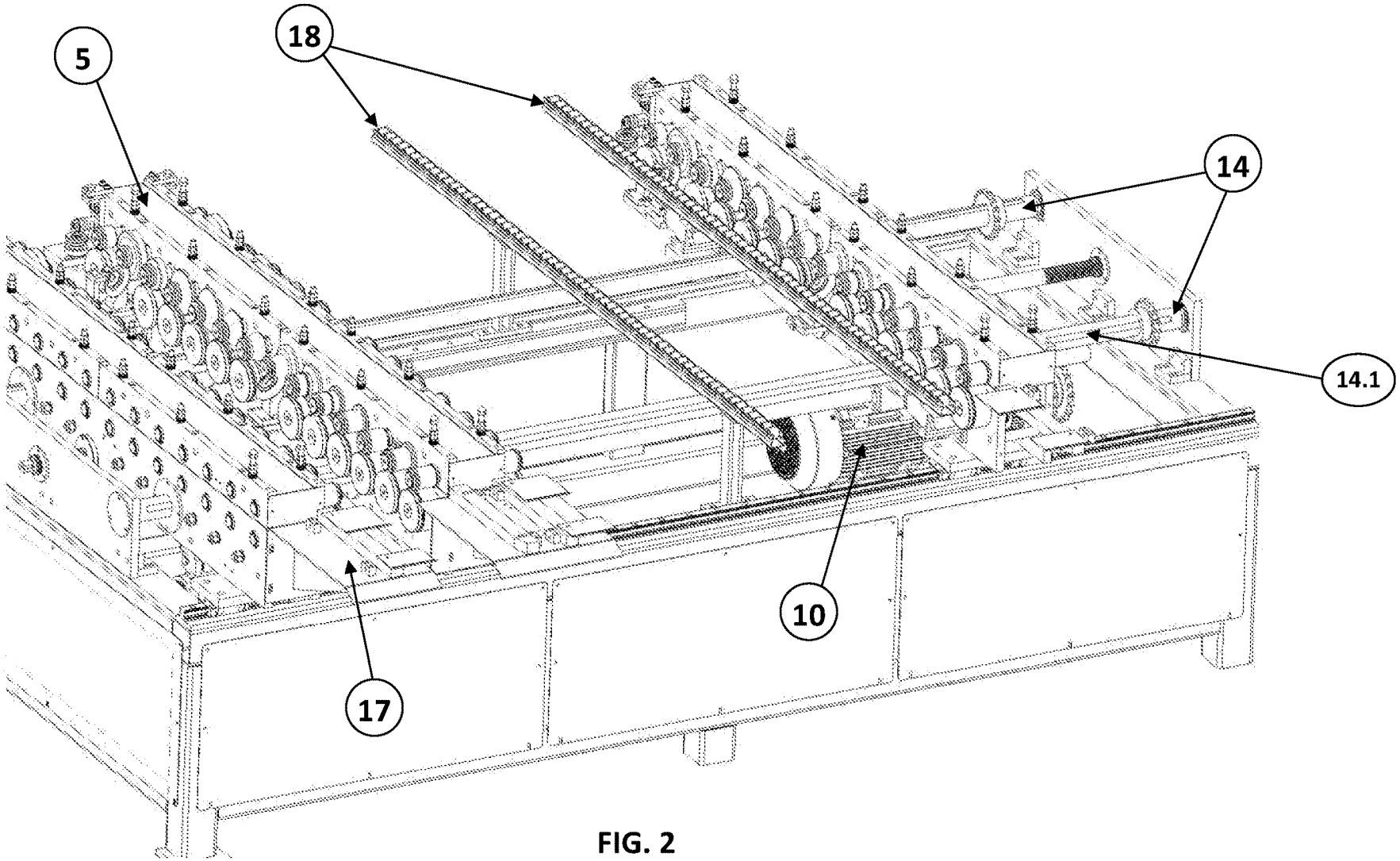
FIG. 2 General perspective view of the middle form pulley unit moved to the left.
Figure 3:
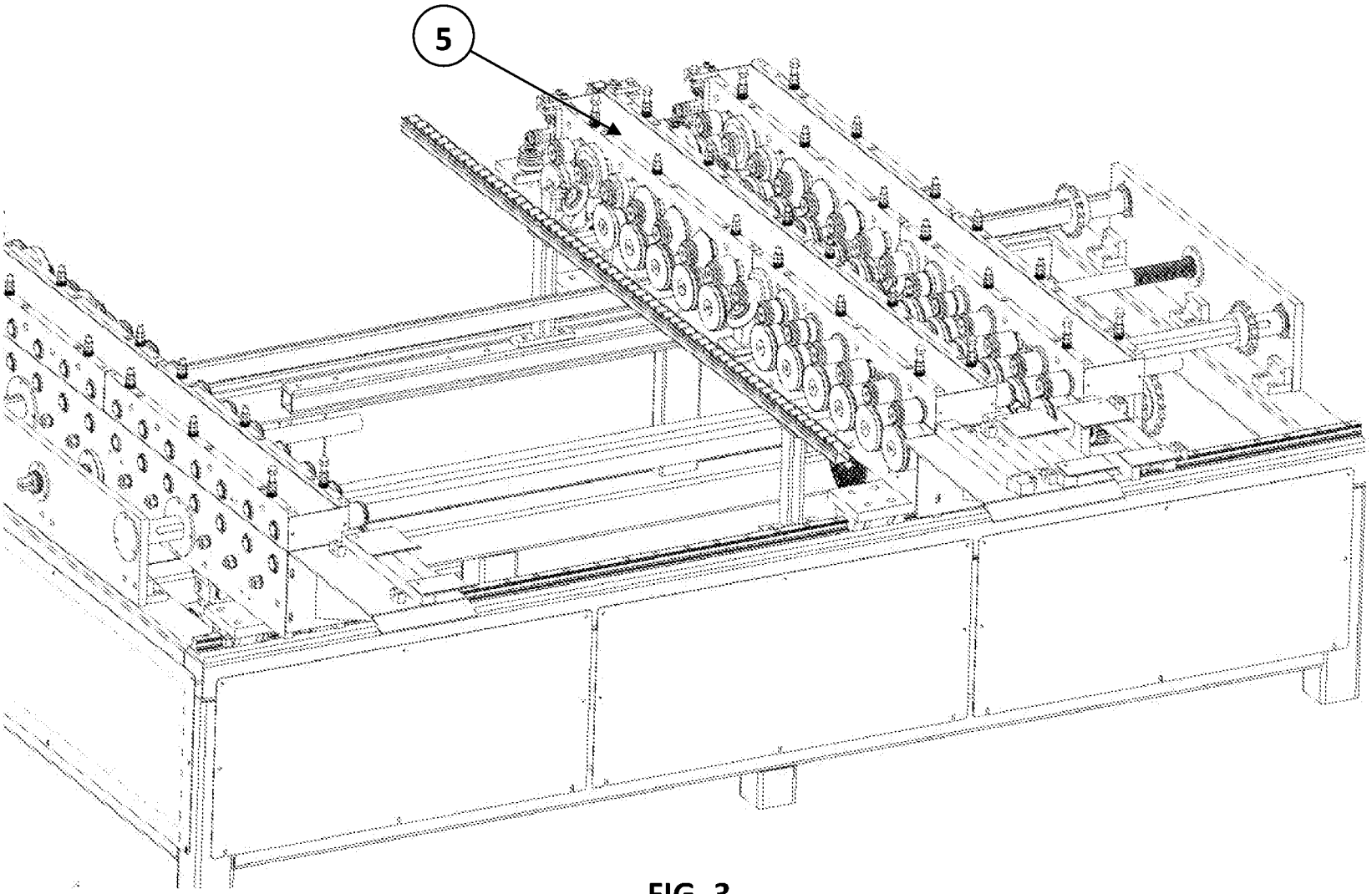
FIG. 3 General perspective view of the middle form pulley unit moved to the right.

In FIGS. 2-3 visuals, the form roller unit 2 (5) with the form roller group 2 (6) moving horizontally on the slide (2) by means of the servo motor (9) is seen. An electric motor or hydraulic motor can be integrated as an alternative to the servo motor (9). The horizontal movement of the form roller unit 1 (3) with form roller group 1 (4) and the form roller unit 3 (7) with form roller group 3 (8) on the slide (2) can be adjusted on the adjusting arm (13) provided with screw threads. The horizontal movement here is more sensitive, so precision machining can be done. This arm (13) can be moved manually as well as by any motor drive.

Figure 4:
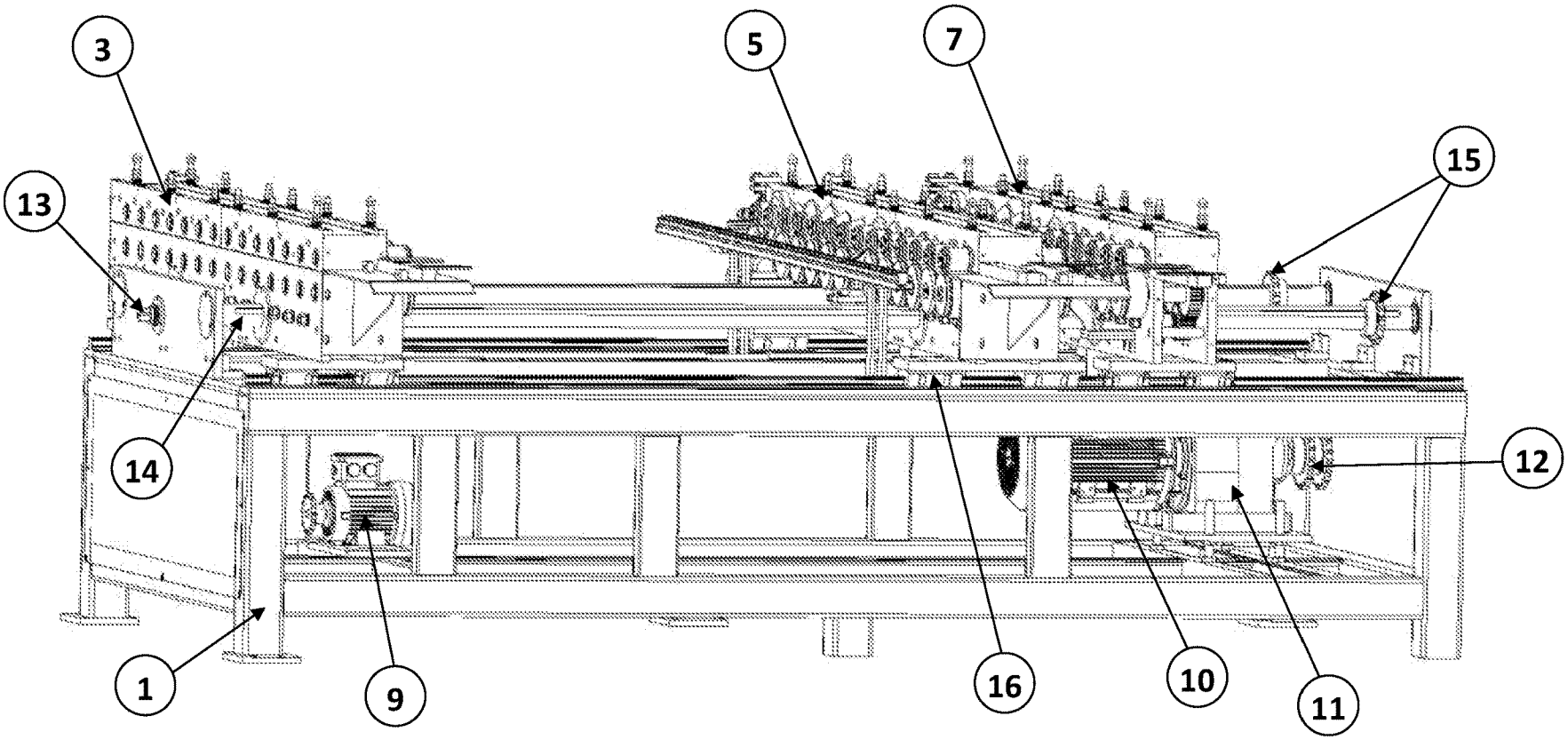
FIG. 4 General perspective view of the system showing the elements at the top and bottom.
Figure 5:
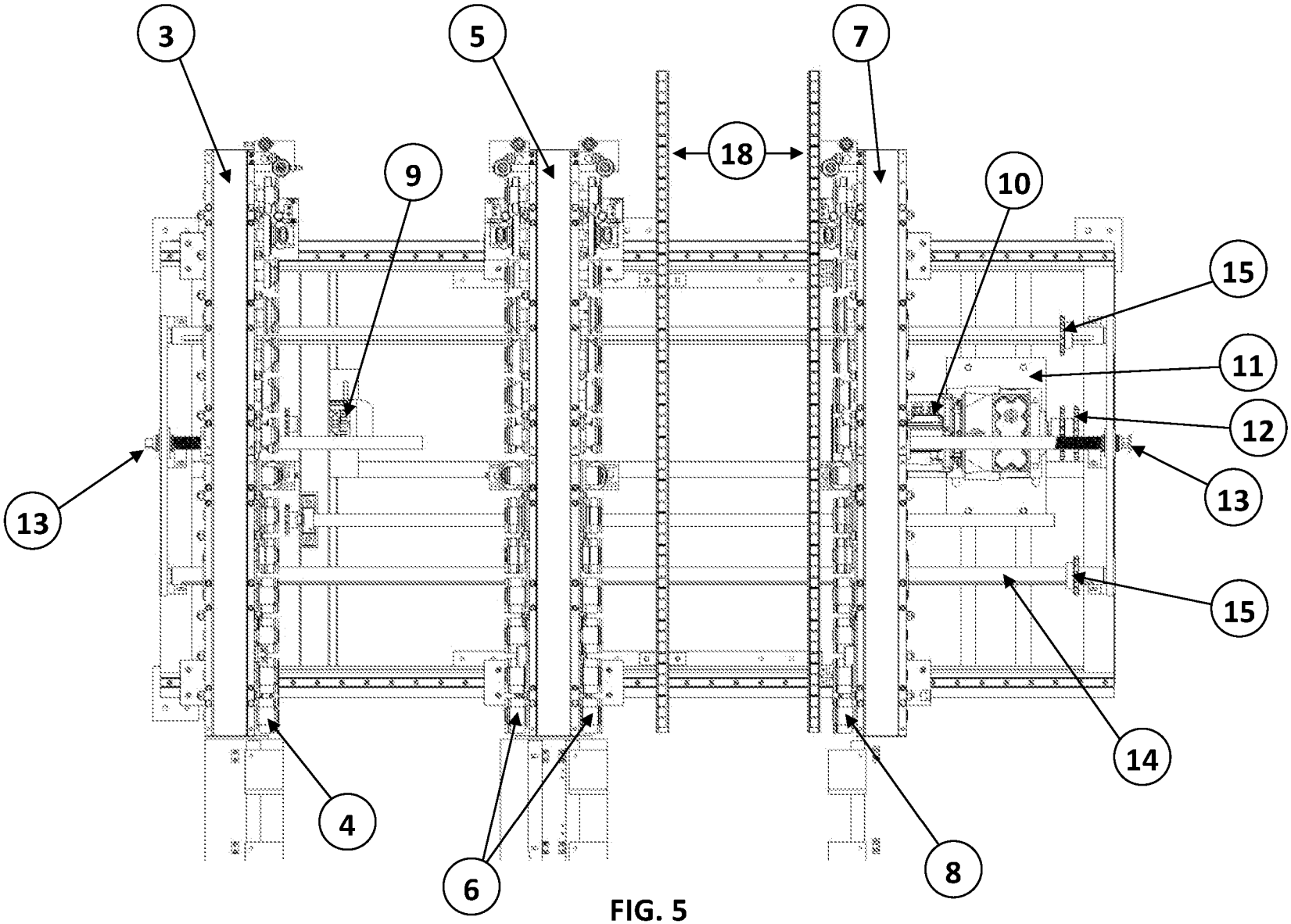
FIG. 5 Top view of the system.

In FIG. 4, the servo motor (9), motor (10), reducer (11) and reducer gears (12) located at the bottom of the main chassis (1) are seen. The motor (10) transmits the driving power to the reducer (11) and the reducer (11) transmits the driving force to the reduction gears (12), thereby enabling the spindle of motion (14) to make circular motion. In FIG. 5, motion drive transmissions can be seen more clearly. Here, a servo motor or hydraulic motor can be integrated as an alternative to the motor (10). Spindle of motion (14) receives the torque coming from the reducer gears (12) through the motion spindle gear (15) on it. The movement drive is transmitted by chain. Alternatively, a pulley can be used instead of the reducer gears (12) and the motion spindle gear (15), and a belt can be used instead of the chain.

What is claimed is:

1. A sliding machine for simultaneously processing two different sheet metals and giving variable forms, comprising:

a main frame,
a first form roller unit positioned on a left side of the main frame,
a first form roller group positioned on a right side of the main frame,
a third form roller group,
a third form roller unit,
sheet metal support wedges configured to serve as support during an entry of a sheet into a system,
a slide fixed to side parts on an upper surface of the main frame,
a second form roller unit positioned to move horizontally on the slide and located between the first form roller unit and the third form roller unit,
a servo motor configured to give a horizontal motion drive to the second form roller unit,
two spindles of motion configured to transmit a motion drive to rollers in the first form roller group, a second form roller group and the third form roller group through a wedge channel formed from one end to the other,
a motion spindle gear fixed to an end of each of the two spindles of motion,
a motor configured to give a driving power to the two spindles of motion,
a reducer positioned on an output shaft of the motor,
a reducer gear sequentially fixed on an output shaft of the reducer, and
two sheet metal moving rails that contain at least one wheeled structure in order to facilitate a progress of the sheet entering the system and whose edges will be processed on a line.

2. The sliding machine according to claim 1, wherein the second form roller unit has the second form roller group fixed on both sides.

3. The sliding machine according to claim 1, wherein the sliding machine has a movement motion spindle gear associated with the reducer gear.

4. The sliding machine according to claim 1, wherein the sliding machine has an adjustment arm, and the first form roller unit and the third form roller unit are provided on the adjustment arm by screw threads to allow precise movement in a horizontal plane.

5. The sliding machine according to claim 4, wherein the adjustment arm performs a manual movement.

6. The sliding machine according to claim 1, wherein each of the two sheet metal moving rails has pin holes for height adjustment.

7. The sliding machine according to claim 1, wherein the first form roller unit, the second form roller unit and the third form roller unit have at least one sledding foot configured to act as a bedding for horizontal movement on the slide.

8. The sliding machine according to claim 1, wherein the sliding machine has an electric or hydraulic motor that is used instead of the servo motor.

9. The sliding machine according to claim 1, wherein the sliding machine has a servo or hydraulic motor that is used instead of the motor.

10. The sliding machine according to claim 1, wherein the sliding machine has at least one pulley that is used instead of the reducer gears and the motion spindle gear.

* * * * *